US005867076A

United States Patent [19]

Tada et al.

[11] Patent Number: 5,867,076

[45] **Date of Patent: *Feb. 2, 1999**

[54] DIELECTRIC RESONATOR AND DIELECTRIC RESONANT COMPONENT HAVING STEPPED PORTION AND NON-CONDUCTIVE INNER PORTION

[75] Inventors: Hitoshi Tada; Hideyuki Kato; Tatsuya Tsujiguchi; Yukihiro Kitaichi; Tadahiro Yorita; Haruo Matsumoto; Hisashi Mori, all of Kyoto, Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 808,124

[22] Filed: Feb. 28, 1997

Related U.S. Application Data

[63] Continuation of Ser. No. 649,929, May 16, 1996, abandoned, which is a continuation of Ser. No. 489,775, Jun. 13, 1995, abandoned, which is a continuation of Ser. No. 96,515, Jul. 23, 1993, abandoned.

[30] Foreign Application Priority Data

Jul. 24, 1992 [JP] Japan ..... 4-057669 U
Dec. 4, 1992 [JP] Japan ..... 4-350899

[51] Int. Cl.[6] ..... H01P 1/202; H01P 7/04

[52] U.S. Cl. ..... 333/206; 333/222

[58] Field of Search ..... 333/202, 206, 333/207, 222, 223, 219

[56] References Cited

U.S. PATENT DOCUMENTS

| | | | |
|---|---|---|---|
| 3,505,618 | 4/1970 | McKee | 333/203 |
| 4,464,640 | 8/1984 | Nishikawa et al. | 333/202 |
| 4,506,241 | 3/1985 | Makimoto et al. | 333/222 |
| 4,523,162 | 6/1985 | Johnson | 333/202 |
| 4,733,208 | 3/1988 | Ishikawa et al. | 333/206 X |
| 4,985,690 | 1/1991 | Eguchi et al. | 333/206 X |

FOREIGN PATENT DOCUMENTS

| | | | |
|---|---|---|---|
| 0040802 | 2/1987 | Japan | 333/202 |
| 0183603 | 8/1987 | Japan | 333/206 |
| 0220502 | 9/1989 | Japan | 333/202 |
| 3-70403 | of 1991 | Japan . | |
| 0103203 | 4/1992 | Japan | 333/202 |
| 0200101 | 7/1992 | Japan | 333/206 |

*Primary Examiner*—Benny Lee
*Assistant Examiner*—Justin P. Bettendorf
*Attorney, Agent, or Firm*—Ostrolenk, Faber, Gerb & Soffen, LLP

[57] ABSTRACT

A dielectric resonator including a dielectric block through which an inner conductor formation hole passes; an inner conductor partially formed on an inner surface of the inner conductor formation hole; and an outer conductor formed on an outer surface of the dielectric block. A portion where the inner conductor is not formed is provided on the inner surface of the inner conductor formation hole in the vicinity of one open end portion of the inner conductor formation hole. A stepped portion is provided at a predetermined position on one of the inner surface of the inner conductor formation hole and the outer surface of the dielectric block. Two portions with corresponding resonant characteristics and respective line impedances different from each other are provided with a boundary defined by the stepped portion between the two portions.

26 Claims, 11 Drawing Sheets

DIELECTRIC RESONATOR AND DIELECTRIC RESONANT COMPONENT HAVING STEPPED PORTION AND NON-CONDUCTIVE INNER PORTION

This is a continuation of application Ser. No. 08/649,929, filed on May 16, 1996, now abandoned; which is a continuation of application Ser. No. 08/489,775, filed on Jun. 13, 1995, now abandoned; which is a continuation of application Ser. No. 08/096,515, filed on Jul. 23, 1993, now abandoned.

BACKGROUND OF THE INVENTION

1. Field of the Invention

The invention relates to a dielectric resonator and a dielectric resonant component, and more particularly to a dielectric resonator and a dielectric resonant component having a structure in which an inner conductor and an outer conductor are formed inside and outside a dielectric block, respectively.

2. Discussion of the Related Art

As a conventional small-sized resonator which has a high Q (i.e., low loss) and is used for a high frequency band (for example, VHF-SHF bands), a coaxial type dielectric resonator is well known. FIGS. 22(*a*), 22(*b*) and 23(*a*), 23(*b*) show the configuration of two types of conventional dielectric resonators, respectively, which are disclosed in Japanese Patent Examined Publication (Kokoku) No. HEI 3-70403. FIGS. 22(*a*) and 23(*a*) are longitudinal sectional views of the respective dielectric resonators, and FIGS. 22(*b*) and 23(*b*) are front views of the respective dielectric resonators.

First, the configuration of the dielectric resonator of FIGS. 22(*a*) and 22(*b*) will be described. In FIGS. 22(*a*) and 22(*b*), an inner conductor formation hole 5 extending in the axial direction is formed in the center portion of a column-like dielectric block 1. On the entire inner surface of the inner conductor formation hole 5, an inner conductor 2 is formed, and, on the outer surface of the dielectric block 1 other than one end surface 1*a*, an outer conductor 4 is formed. As a result, the one end surface 1*a* of the dielectric block 1 functions as an open end surface at which the inner conductor 2 and the outer conductor 4 are not formed. The other end surface 1*b* of the dielectric block 1 functions as a short-circuit end surface at which the inner conductor 2 and the outer conductor 4 are short-circuited. In the dielectric resonator of FIGS. 22(*a*) and 22(*b*), a stepped portion 51 is formed in the inside of the inner conductor formation hole 5. According to the configuration, two resonant portions r1 and r2 having different line impedances are formed with the stepped portion 51 as a boundary. The line length $L_1$ of the resonant portion r1 which is closer to the open end surface 1*a*, and the line length $L_2$ of the resonant portion r2 which is closer to the short-circuit end face 1*b* are equal to each other. In the dielectric resonator of FIGS. 22(*a*) and 22(*b*), the stepped portion 51 is formed so that a spurious resonant frequency does not exist at an integral multiple of the basic resonant frequency.

The dielectric resonator of FIGS. 23(*a*) and 23(*b*) has substantially the same structure as that of the dielectric resonator of FIGS. 22(*a*) and 22(*b*). Corresponding elements are designated by like reference numerals. In the dielectric resonator of FIGS. 23(*a*) and 23(*b*), a stepped portion 101 is formed on the outer surface of the dielectric block 1. The stepped portion 101 is formed for the same purpose as that for the above-mentioned stepped portion 51. The line length $L_1$ of the resonator portion r1 which is closer to the open end surface 1*a*, and the line length $L_2$ Of the resonator portion r2 which is closer to the short-circuit end surface 1*b* are equal to each other.

In various filters (a bandpass filter (BPF), a band-elimination filter (BEF), etc.), oscillators and the like which are used in an apparatus such as a radio communication apparatus for a high frequency band, a dielectric resonant component which is constituted by a plurality of dielectric resonators is adopted in many cases, thereby improving the characteristics and miniaturizing the apparatus. Conventionally, in order to attain desired frequency characteristics, such a dielectric resonant component is constructed in the following manner: A plurality of separate dielectric resonators such as shown in FIGS. 22(*a*) and 22(*b*) or 23(*a*) and 23(*b*) are prepared, and arranged within one case. Then, the dielectric resonators are coupled to each other via external coupling elements. However, in such a structure, the number of parts is increased, and the weight is also increased. Therefore, there has been a need for a dielectric resonant component which has a further reduced size and a reduced weight. Especially for a modern mobile communication device (a portable telephone, an automobile telephone, etc.), owing to the conditions of use thereof, it is desirable that a resonator component used therein be small and light.

In response, a dielectric resonant component which has a reduced size and a reduced weight has already been realized by combining a plurality of dielectric resonators into one unit within a single dielectric block. FIG. 24 is an exploded perspective view showing such a conventional dielectric resonant component. In FIG. 24, a dielectric block 1 having a substantially hexahedral shape is provided with, for example, three inner conductor formation holes H1 to H3, and coupling holes h1 and h2 which are disposed between the respective inner conductor formation holes H1 to H3. On the inner surfaces of the inner conductor formation holes H1 to H3, inner conductors are formed, respectively. On the outer surface of the dielectric block 1 other than an open end surface 1*a*, an outer conductor 4 is formed. So-called resin pins P1 and P3 include resin portions P1a and P3a, and signal input/output terminals P1b and P3b, respectively. By inserting the two resin pins P1 and P3 into the inner conductor formation holes H1 and H3, respectively, from the open end face 1*a* side of the dielectric block 1, the signal input/output terminals P1b and P3 b are capacitively coupled with the inner conductors of the inner conductor formation holes H1 and H3. A cover 100 is provided for holding the dielectric block 1 and the resin pins P1 and P3, and for covering the open end surface 1*a* of the dielectric block 1 in order to prevent leakage of the electromagnetic field. After inserting the resin pins P1 and P3 into the dielectric block 1 and placing the cover 100 thereon, all the parts are combined into one unit by soldering the cover 100 to the outer conductor 4. Protrusions 100*a* and 100*b* of the cover 100 function as ground terminals when the above-mentioned dielectric resonant component is mounted on a circuit board.

In the dielectric resonators of FIGS. 22(*a*), 22(*b*) and 23(*a*), 23(*b*), since the outer conductor 4 is not formed on the open end surface 1*a* of the dielectric block 1, there arises a problem in that the electromagnetic field leaks from the open end surface 1*a*. Specifically, when a conductor of another circuit element comes close to the open end surface 1*a*, the circuit element may be adversely affected. The dielectric resonator may be coupled with an external electromagnetic field, resulting in that the desired characteristics of the dielectric resonator cannot be obtained. In addition, when the resonant frequency of the dielectric resonators of FIGS.

22(*a*), 22(*b*) or 23(*a*), 23(*b*) is to be changed, it is necessary to change the axial length ($L_1+L_2$) of the dielectric block 1. Accordingly, for each of various required resonant frequencies, a dielectric block having a different size must be prepared, and thus the parts cannot be standardized. As a result, there also arise problems in that mass productivity is reduced, and that production cost is increased.

By contrast, in the dielectric resonant component of FIG. 24, the electromagnetic field leakage from the open end surface 1*a* is reduced by placing the cover 100 on the dielectric block 1. However, the provision of the cover 100 is not sufficient to completely prevent the electromagnetic field leakage from the open end surface 1*a*. This produces a problem in that the electromagnetic field still leaks from the open end surface 1*a* to interfere with other circuit elements, and also problems in that the number of parts is increased, and that it is difficult to reduce the height of the dielectric resonant component because of the thickness of the cover 100. Furthermore, in the dielectric resonant component of FIG. 24, as in the dielectric resonators of FIGS. 22(*a*), 22(*b*) and 23(*a*), 23(*b*), when the resonant frequency of each dielectric resonator is to be changed, the size of the dielectric block 1 must be changed. Therefore, there are problems in that the parts cannot be standardized, and that production cost is increased. Moreover, in the dielectric resonant component of FIG. 24, when the degree of coupling or the coupling relationship between the respective dielectric resonators (either the inductive coupling or the capacitive coupling) is to be changed without changing the size of the dielectric block 1, a coupling element such as a capacitor, a coil or the like must be externally connected, thereby producing a problem in that the number of parts is increased.

SUMMARY OF THE INVENTION

Therefore, it is an object of the present invention to provide a small-sized dielectric resonator in which the electromagnetic field leakage can be prevented from occurring in a substantially complete manner, and the characteristics of the dielectric resonator can easily be adjusted.

It is another object of the invention to provide a small-sized dielectric resonant component in which the electromagnetic field leakage can be prevented from occurring in a substantially complete manner, and the characteristics thereof can easily be adjusted.

The above-mentioned objects of the invention have been achieved by provision of a dielectric resonator which comprises: a dielectric block having an inner conductor formation hole which is formed in the inside of the dielectric block 1; an inner conductor formed on an inner surface of the inner conductor formation hole with a portion where the inner conductor is not formed being provided in the inside of the inner conductor formation hole in the vicinity of one open end portion of the inner conductor formation hole; and an outer conductor formed on an outer surface of the dielectric block, wherein the outer conductor covers the entire outer surface of the dielectric block, a stepped portion is provided at an arbitrary position in the inside of the inner conductor formation hole or on the outer surface of the dielectric block, and two resonant portions which have different line impedances are formed, the stepped portion being a boundary between said two resonant portions.

Also, according to the dielectric resonator of the invention, line lengths of the two resonant portions formed with the stepped portion as a boundary are different from each other.

Further, the above objects of the invention have been achieved by provision of a dielectric resonant component which comprises: a dielectric block having a plurality of inner conductor formation holes which are formed in the inside of the dielectric block 1; an inner conductor formed on an inner surface of each of the inner conductor formation holes with a portion where the inner conductor is not formed being provided in the inside of each of the inner conductor formation holes in the vicinity of one open end portion of each of the inner conductor formation holes; and an outer conductor formed on an outer surface of the dielectric block, wherein the outer conductor covers the entire outer surface of the dielectric block, a stepped portion is provided at an arbitrary position in the inside of at least one of the inner conductor formation holes, or on the outer surface of the dielectric block, each of the inner conductors cooperates with the outer conductor to constitute a separate dielectric resonator, and each of the dielectric resonators has two resonant portions which have different line impedances, the stepped portion being a boundary between the two resonant portions.

Also, according to the dielectric resonant component of the invention, an inner conductor formation hole with the stepped portion and an inner conductor formation hole without the stepped portion are disposed in combination.

In the dielectric resonator of the invention, the outer conductor is formed so as to cover the entire outer surface of the dielectric block, and a portion where the inner conductor is not formed is provided in the inside of the inner conductor formation hole, whereby the electromagnetic field leakage from the open end of the resonator can substantially completely be prevented from occurring. A portion in which the inner conductor is not formed is provided in the inside of the inner conductor formation hole, so that a tip capacitance is formed to the tip of the inner conductor. As a result, the axial length of the dielectric block can be reduced, and hence the dielectric resonator can be miniaturized. In addition, the characteristics (the resonant frequency, etc.) of the dielectric resonator can be changed without changing the external dimension of the dielectric block, but by changing only the width and position of the portion where the inner conductor is not formed, the height and position of the stepped portion, etc. Therefore, the parts can be standardized, and the production cost can be lowered.

Also, in the dielectric resonator of the invention, the line lengths of the two resonant portions which are formed with the stepped portion as a boundary are selected to be different from each other, whereby the axial length of the dielectric block is further reduced.

In the dielectric resonant component, the outer conductor is formed so as to cover the entire outer surface of the dielectric block, and a portion where the inner conductor is not formed is provided in the inside of each of the inner conductor formation holes, so that the electromagnetic field leakage from the open end of each of the dielectric resonators can substantially completely be prevented. Unlike a prior art dielectric resonator, a cover for preventing the electromagnetic field leakage is not required, whereby the number of parts can be reduced and the height can be reduced. Moreover, the characteristics (the resonant frequency of each of the dielectric resonators, the coupling constant between the respective dielectric resonators, and the coupling condition between the respective dielectric resonators) of the dielectric resonant component can be changed without changing the external dimension of the dielectric block, and without performing the adjustment using external coupling elements, but only by changing the width and position of the portion where the inner conductor is not formed, the height and position of the stepped portions, etc. Therefore, the parts can be standardized, and the number of parts can be reduced.

Also, in the dielectric resonant component of the invention, an inner conductor formation hole with a stepped portion and an inner conductor formation hole without a stepped portion are disposed in combination in a single dielectric block, whereby the attenuation characteristics in both the higher frequency side and the lower frequency side can be improved.

BRIEF DESCRIPTION OF THE DRAWINGS

FIG. 5(*b*) is a front view of the dielectric resonator of FIG. 5(*a*);

FIG. 22(*b*) is a front view of the exemplary conventional dielectric resonator of FIG. 22(*a*);

FIG. 23(*b*) is a front view of the exemplary conventional dielectric resonator of FIG. 23(*a*)

DETAILED DESCRIPTION OF THE PREFERRED EMBODIMENTS

Figure 1:
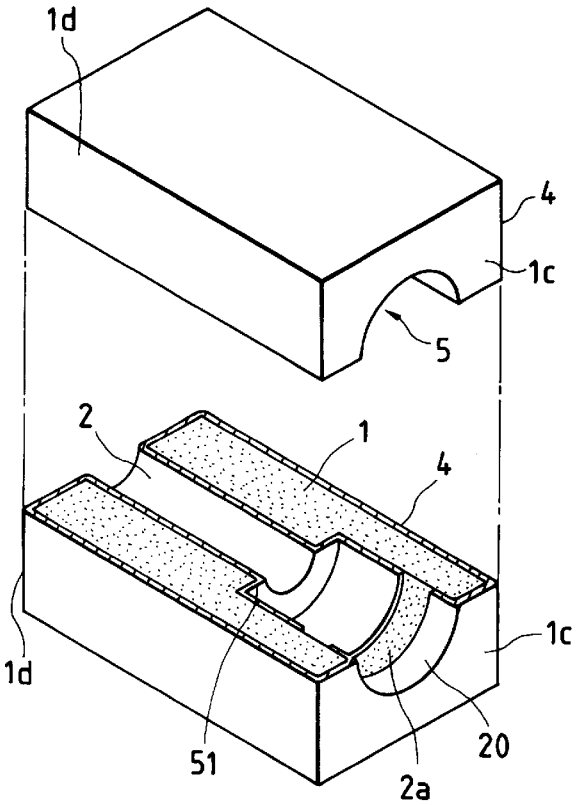
FIG. 1 is an exploded perspective view showing a dielectric resonator according to an embodiment of the invention.
Figure 2:
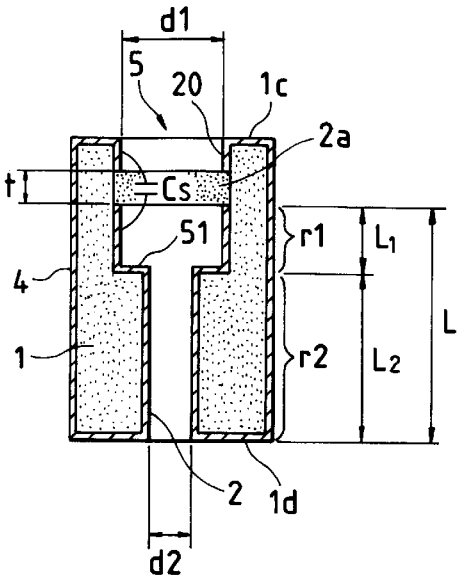
FIG. 2 is a sectional view of the dielectric resonator of FIG. 1.

FIG. 1 is an exploded perspective view showing a dielectric resonator according to an embodiment of the invention in which the dielectric resonator is cut along the center level plane. FIG. 2 is a sectional view showing the cut plane of the dielectric resonator of FIG. 1 as viewed from above. As shown in FIGS. 1 and 2, in a dielectric block 1 having a substantially rectangular parallelepiped shape, an inner conductor formation hole 5 is formed so as to pass through the dielectric block 1 from a first end surface 1*c* to a second end surface 1*d*, and to extend in the axial direction thereof. The first end surface 1*c* is opposite to the second end surface 1*d*. On the outer surface of the dielectric block 1, an outer conductor 4 is formed so as to cover the entire six faces of the dielectric block 1, by a technique such as baking or electroless plating. On the inner surface of the inner conductor formation hole 5, a stepped portion 51 is formed at a predetermined position so that, in the inside of the inner conductor formation hole 5, the diameter d1 of the portion from the first end surface 1*c* to the stepped portion 51 is larger than the diameter d2 of the portion from the second end surface 1*d* to the stepped portion 51 (d1>d2). On the inner surface of the inner conductor formation hole 5, an inner conductor 2 is formed by a technique such as baking or electroless plating. At first, the inner conductor 2 is formed on the entire inner surface of the inner conductor formation hole 5. Then, the inner conductor 2 is partly removed so that an inner conductor nonformation portion 2*a* is formed at a position somewhat away from one open end of the inner conductor formation hole 5. A portion of the inner conductor 2 which is continuous with the outer conductor 4 formed on the first end surface 1*c* of the dielectric block 1 is left unremoved so as to function as a tip conductor 20. Accordingly, a tip capacitance Cs is generated between the inner conductor 2 and the tip conductor 20.

As described above, in the dielectric resonator of FIGS. 1 and 2, the entire outer surface of the dielectric block 1 is covered with the outer conductor 4, and the inner conductor nonformation portion 2*a* is formed at a position somewhat away from one open end of the inner conductor formation hole 5. Therefore, the electromagnetic field leakage to the outside of the dielectric resonator can substantially completely be prevented.

Figure 3:
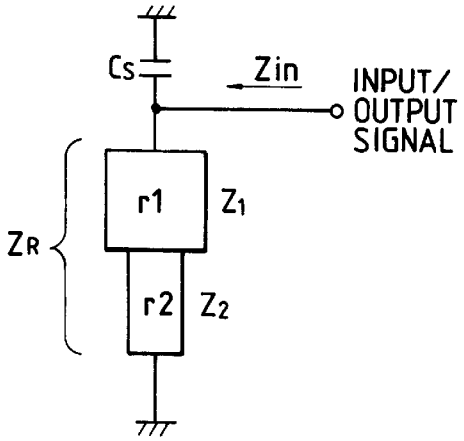
FIG. 3 is an equivalent circuit diagram of the dielectric resonator of FIG. 1.

FIG. 3 is an equivalent circuit diagram of the dielectric resonator of FIGS. 1 and 2. As shown in FIG. 3, the outer conductor 4 is grounded, and a signal is input to or output from the front open end of the inner conductor 2. Two portions r1 and r2, having corresponding resonant characteristics, are formed with the stepped portion 51 as a boundary. The line impedance $Z_1$ of the first resonant portion r1 which is closer to the first end surface 1*c* has a value different from that of the line impedance $Z_2$ of the second resonant portion r2 which is closer to the second end face 1*d* ($Z_1 \neq Z_2$). In addition, the actual line length $L_1$ of the first resonant portion r1 is selected so as to be different from the actual line length $L_2$ of the second resonant portion r2 ($L_1 \neq L_2$). The tip capacitance Cs is coupled to the tip of the first resonant portion r1.

Now, assuming that there is no loss, the input impedance $Z_R$ of the combination of the first and second resonant portions r1 and r2 can be expressed as follows:

$$Z_R = jZ_1(Z_2\tan\theta_2 + Z_1\tan\theta_1)/(Z_1 - Z_2\tan\theta_1 \tan\theta_2) \quad (1)$$

where $\theta_1$ and $\theta_2$ represent electrical lengths of the first and second resonant portions r1 and r2, respectively, and are expressed as follows:

$$\theta_1 = L_1 \cdot \omega(\epsilon_r)^{1/2}/C$$

$$\theta_2 = L_2 \cdot \omega(\epsilon_r)^{1/2}/C$$

where C is the velocity of light.

The input impedance $Z_{in}$ of the whole resonant system including the tip capacitance Cs can be expressed as follows:

$$Z_{in} = Z_R/(1 + j\omega C_S Z_R) \quad (2)$$

When substituting equation (1) into equation (2) and equation (2) is rearranged, the following equation (3) is obtained:

$$Z_{in} = jZ_1(Z_2\tan\theta_2 + Z_1\tan\theta_1)/\{Z_1 - Z_2\tan\theta_1\tan\theta_2 - \omega C_S Z_1(Z_2\tan\theta_2 + Z_1\tan\theta_1)\} \quad (3)$$

Due to the fact that the input impedance $Z_{in}$ is infinite ($Z_{in} = \infty$) at resonance, the denominator of equation (3) is set to be 0, and the resonant condition expression is obtained as follows:

$$\omega_0 C_S = (Z_1 - Z_2\tan\theta_1'\tan\theta_2')/Z_1(Z_2\tan\theta_2' + Z_1\tan\theta_1') \quad (4)$$

The dielectric resonator of FIG. 1 resonates at a frequency $\omega_0$ for which equation (4) is valid. In equation (4), $\theta_1'$ and $\theta_2'$ are respectively expressed as follows:

$$\theta_1' = L_1 \cdot \omega_0(\epsilon_r)^{1/2}/C$$

$$\theta_2' = L_2 \cdot \omega_0(\epsilon_r)^{1/2}/C$$

Figure 4:
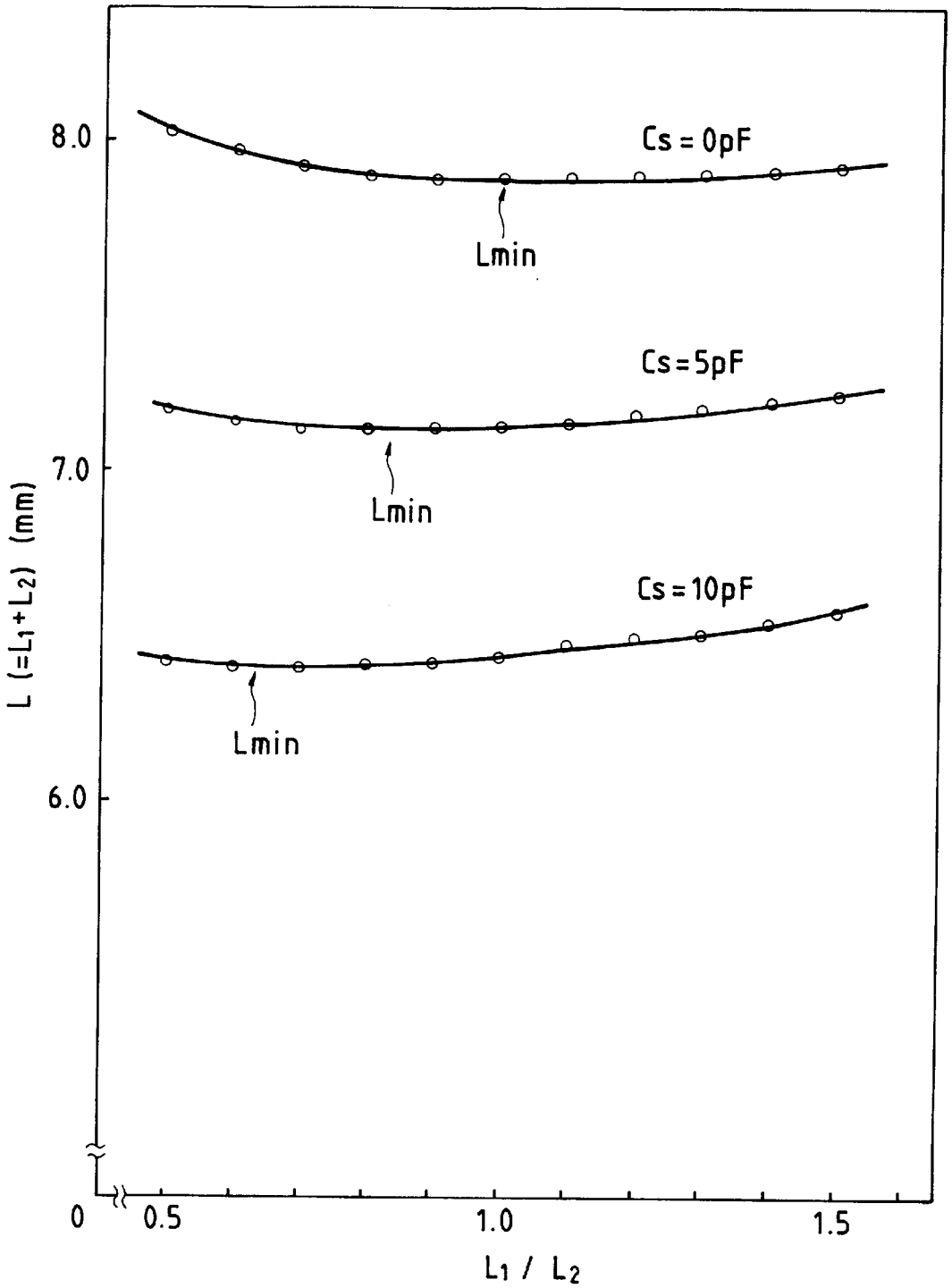
FIG. 4 is a graph showing the relationship in each resonant portion between the line length ratio $L_1/L_2$ and the total line length L ($=L_1+L_2$) in the case where the dielectric resonator of FIG. 1 or the conventional dielectric resonator of FIG. 22 satisfies prescribed resonant conditions.
Figure 22A:
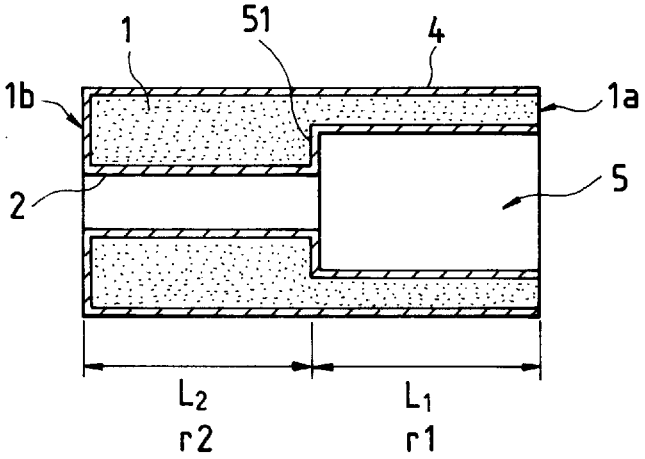
FIG. 22(a) PRIOR ART
FIG. 22(*a*) is a sectional view of an exemplary conventional dielectric resonator.
Figure 22B:
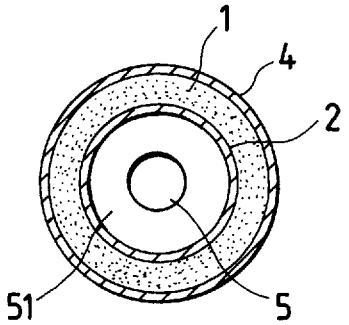
FIG. 22(b) PRIOR ART
Figure 23A:
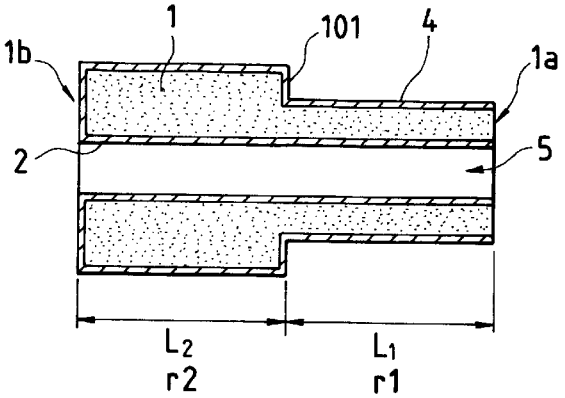
FIG. 23(a) PRIOR ART
FIG. 23(*a*) is a sectional view of another exemplary conventional dielectric resonator.
Figure 23B:
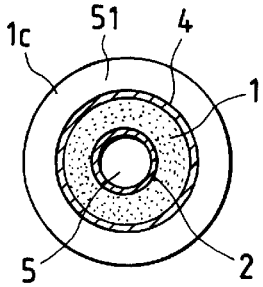
FIG. 23(b) PRIOR ART
Figure 24:
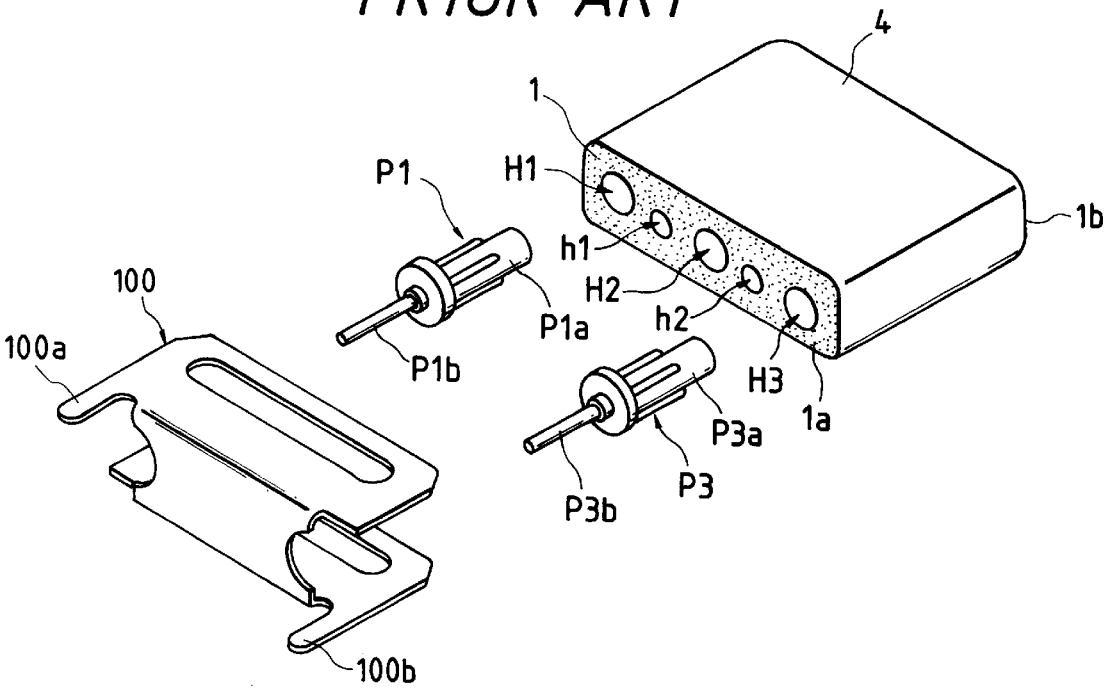
FIG. 24 PRIOR ART
FIG. 24 is an exploded perspective view showing an exemplary conventional dielectric resonant component.

FIG. 4 is a graph showing the relationship in each resonant portion between the line length ratio $L_1/L_2$ and the total line length L ($=L_1+L_2$) in the case where the dielectric resonator of the embodiment of FIG. 1 or the conventional dielectric resonator of FIG. 22 satisfies the resonant condition of equation (4). Referring to FIG. 4, in the case where the tip capacitance Cs is added to the tip of the inner conductor 2 as in the dielectric resonator of the invention (the case where the tip capacitance Cs is 5 pF or 10 pF), the total line length L is reduced as compared with the case where the tip capacitance Cs is not added as in the conventional dielectric resonator (the case where the tip capacitance Cs is 0 pF). As a result, the size of the dielectric block 1 is reduced, and hence the size of the dielectric resonator is reduced. In addition, it will be noted that, when the line length $L_1$ of the first resonant portion r1 is different from the line length $L_2$ of the second resonant portion r2 ($L_1 \neq L_2$), the total line length L has the minimum value of $L_{min}$. In the dielectric resonator of the embodiment, the respective line lengths $L_1$ and $L_2$ are selected to be different from each other so that the total line length L is the minimum length $L_{min}$.

As seen from equation (4), by changing the value of the tip capacitance Cs, the resonant frequency $\omega_0$ is changed. The tip capacitance Cs can be adjusted by changing the width of the inner conductor nonformation portion 2*a*. The resonant frequency $\omega_0$ is changed also by changing the line impedances $Z_1$ and $Z_2$ or line lengths $L_1$ and $L_2$ of the resonant portions r1 and r2. The line impedances $Z_1$ and $Z_2$ and the line lengths $L_1$ and $L_2$ can be adjusted by changing the position of the inner conductor nonformation portion 2*a*, and the step difference and position of the stepped portion 51. Thus, in the dielectric resonator of this embodiment, the characteristics thereof can be adjusted without changing the external dimension of the dielectric block 1. Therefore, the parts can be standardized among resonators for different resonant frequencies, so that the mass productivity is improved. As a result, the production cost can be lowered.

Figure 5A:
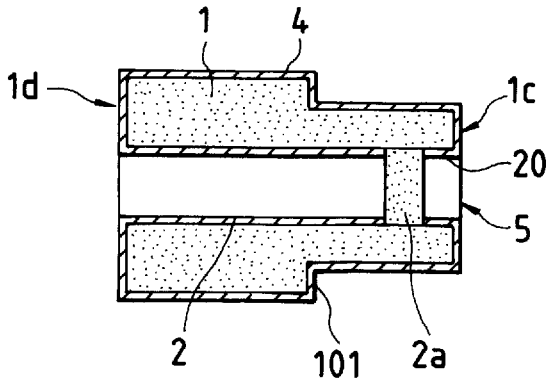
FIG. 5(*a*) is a sectional view of a dielectric resonator according to another embodiment of the invention.
Figure 5B:
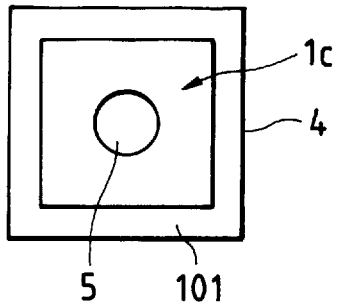

FIGS. 5(*a*) and 5(*b*) show the configuration of a dielectric resonator of another embodiment of the invention, in which FIG. 5(*a*) is a longitudinal sectional view of the dielectric resonator, and FIG. 5(*b*) is a front view of the dielectric resonator. The embodiment of FIGS. 5(*a*) and 5(*b*) has the same configuration as that of the embodiment of FIGS. 1 and 2, except that a stepped portion is not formed in the inside of the inner conductor formation hole 5, and a stepped portion 101 is formed on the outer surface of a dielectric block 1. Corresponding elements are designated by like reference numerals, and their description is omitted. Also in this case where the stepped portion 101 is formed on the outer surface of the dielectric block 1, the line impedance is changed at the stepped portion 101 in the same manner as the embodiment of FIG. 1. Therefore, by changing the position and step difference of the stepped portion 101, the characteristics of the dielectric resonator can be changed.

Figure 6:
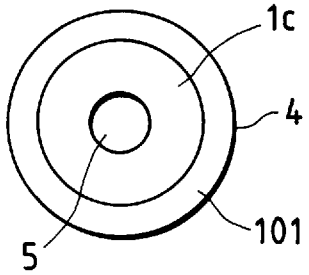
FIG. 6 is a front view showing the configuration of a dielectric resonator according to a still further embodiment of the invention.
Figure 7:
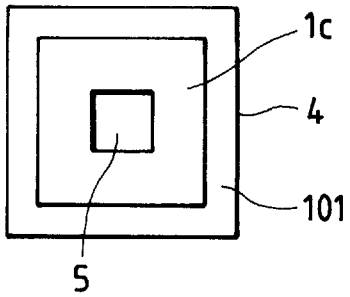
FIG. 7 is a front view showing the configuration of a dielectric resonator according to yet another embodiment of the invention.

In modifications of the embodiment of FIGS. 5(*a*) and 5(*b*), the dielectric block 1 may be circular in section as shown in FIG. 6. Also, the inner conductor formation hole 5 may be square in section as shown in FIG. 7. Alternatively, the dielectric block 1 and the inner conductor formation hole 5 may be formed so as to have yet other shapes.

Figure 8:
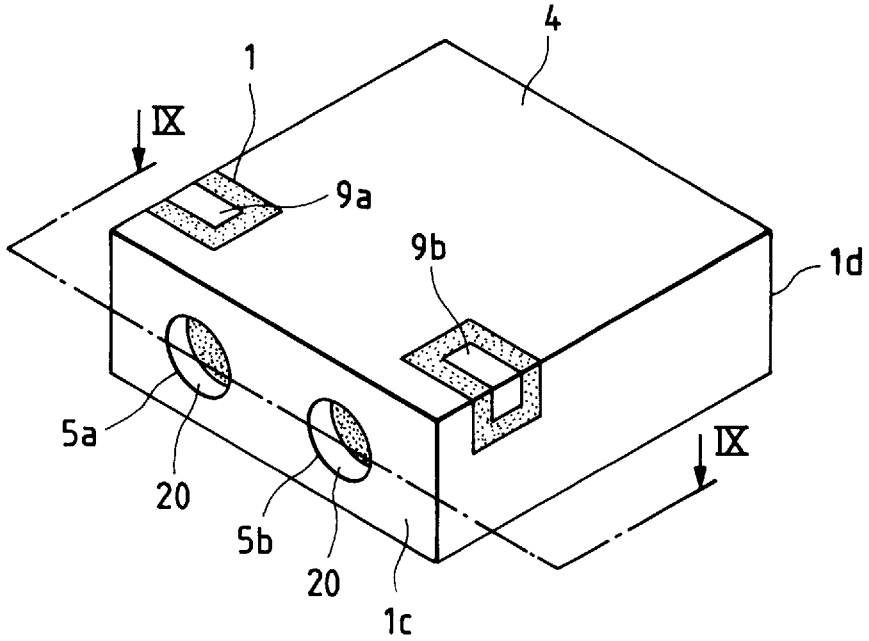
FIG. 8 is a perspective view showing the configuration of a dielectric resonant component according to an embodiment of the invention.

FIG. 8 is a perspective view showing the external configuration of a dielectric resonant component according to an embodiment of the invention. As shown in FIG. 8, a dielectric block 1 having a substantially hexahedral shape is provided with a plurality (in the figure, two) of inner conductor formation holes 5*a* and 5*b* which are formed so as to pass through the dielectric block 1 from a first end surface 1*c* to a second end surface 1*d*. The first end surface 1*c* is opposite to the second end surface 1*d*. On the outer surface of the dielectric block 1, an outer conductor 4 is formed so as to cover substantially the entire surface, by a technique such as baking or electroless plating. On the outer surface of the dielectric block 1, two signal input/output electrodes 9*a* and 9*b* are formed by a technique such as baking or electroless plating, so that the electrodes 9*a* and 9*b* are electrically insulated from the outer conductor 4.

Figure 9:
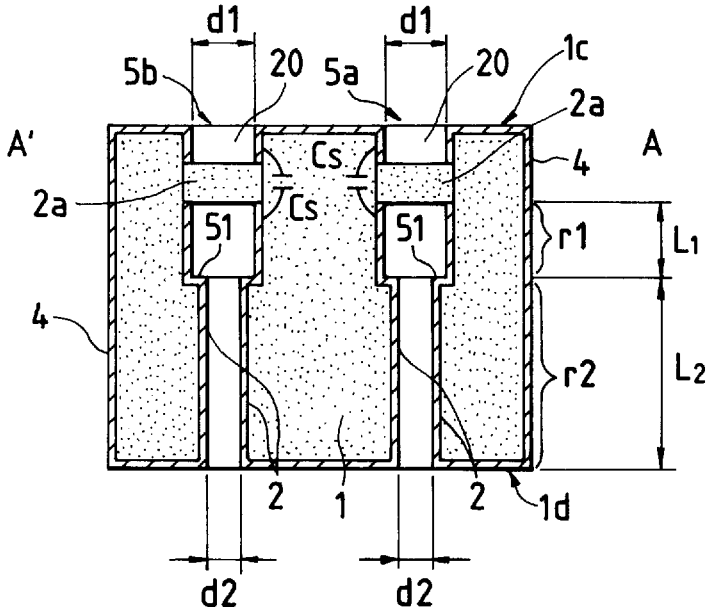
FIG. 9 is a sectional view of the dielectric resonant component of FIG. 8.

FIG. 9 is a sectional view taken along a line IV—IV of FIG. 8. As shown in FIG. 9, on the inner surface of each of the inner conductor formation holes 5*a* and 5*b*, an inner conductor 2 is formed by a technique such as baking or electroless plating. In each of the inner conductor formation holes 5*a* and 5*b*, the inner conductor 2 is partly removed in the vicinity of one open end thereof, so that an inner conductor nonformation portion 2*a* is formed at a position somewhat away from the one open end. A portion of the inner conductor 2 which is continuous with the one open end of each of the inner conductor formation holes 5*a* and 5*b* is left unremoved so as to function as a tip conductor 20. Thus, tip capacitances Cs are generated between the inner conductors 2 in the inner conductor formation holes 5*a* and 5*b*, and the tip conductor 20. In the inside of each of the inner conductor formation holes 5*a* and 5*b*, a stepped portion 51 is formed. Accordingly, in the inside of each of the inner conductor formation holes 5*a* and 5*b*, the diameter d1 of the portion from the first end surface 1*c* to the stepped portion 51 is larger than the diameter d2 of the portion from the second end face 1*d* to the stepped portion 51 (d1>d2). Between the inner conductors 2 in the inner conductor formation holes 5*a* and 5*b*, and the signal input/output electrodes 9*a* and 9*b*, external coupling capacitances Ce are generated, respectively (see FIG. 10).

The dielectric resonant component of FIGS. 8 and 9 utilizes a very small number of parts, so that it is small and light. In addition, it can be mounted onto the surface of a circuit board. Moreover, since substantially the entire outer surface of the dielectric block 1 is covered with the outer conductor 4 and the inner conductor nonformation portion 2*a* is formed at a position somewhat away from the one open end of each of the inner conductor formation holes 5*a* and 5*b*, the electromagnetic field leakage to the outside of the dielectric resonator can substantially completely be suppressed.

Figure 10:
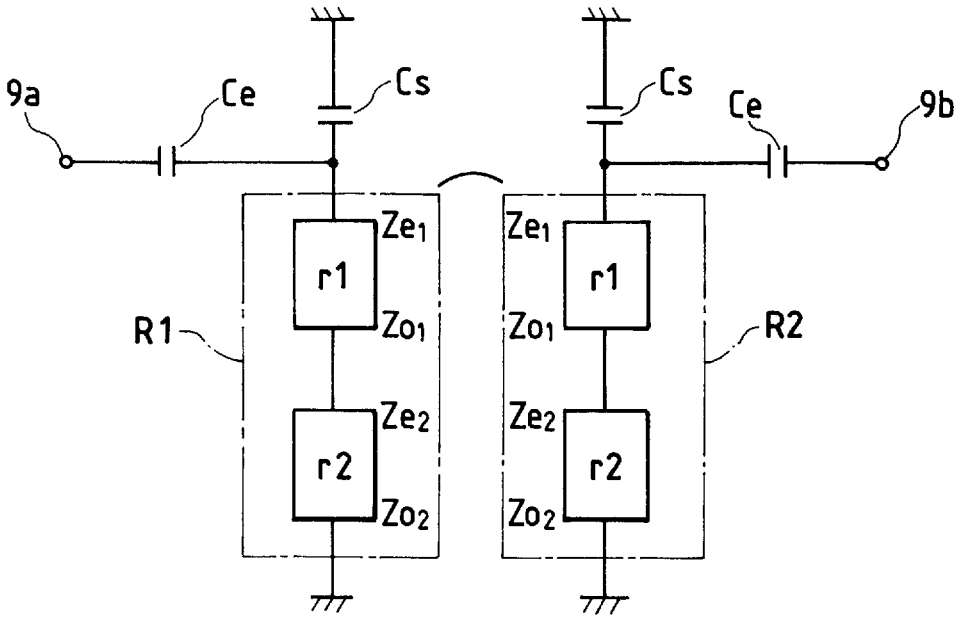
FIG. 10 is an equivalent circuit diagram of the dielectric resonant component of FIG. 8.

FIG. 10 is an equivalent circuit diagram of the dielectric resonant component of FIGS. 8 and 9. As shown in FIG. 10, the dielectric resonant component of FIGS. 8 and 9 has a so-called comb-line coupling in which a dielectric resonator R1 in the inner conductor formation hole 5*a* is coupled with a dielectric resonator R2 in the inner conductor formation hole 5*b*. Between the dielectric resonators R1 and R2 and the grounded outer conductor 4, the tip capacitances Cs are generated, respectively. Between the dielectric resonator R1 and the signal input/output electrode 9*a*, and between the dielectric resonator R2 and the signal input/output electrode 9*b*, external coupling capacitances Ce are generated, respectively.

Each of the dielectric resonators R1 and R2 includes the first and second resonant portions r1 and r2 separated from each other by the stepped portion 51. As shown in FIG. 9, the first resonant portion r1 has a line length $L_1$, and the second resonant portion r2 has a line length $L_2$. In the same manner as the dielectric resonator of FIG. 1, the line length $L_1$ and the line length $L_2$ are selected to be different from each other. Accordingly, the axial length of the dielectric block 1 (i.e., the length of each of the inner conductor formation holes 5*a* and 5*b* in the axial direction) can be reduced.

It is assumed that the characteristic impedances in an even mode and an odd mode of the first resonant portion r1 are represented by $Ze_1$ and $Zo_1$, and the characteristic impedances in an even mode and an odd mode of the second resonant portion r2 are represented by $Ze_2$ and $Zo_2$, respectively. The dielectric resonators R1 and R2 are coupled with each other when the following condition is satisfied:

$$Ze_1/Ze_2 \neq Zo_1/Zo_2$$

Under the following condition:

$Ze_1/Ze_2 > Zo_1/Zo_2$, the tendency of capacitive coupling is increased, and the pass band of the dielectric resonant component is narrowed. In contrast, under the following condition:

$Ze_1/Ze_2 < Zo_1/Zo_{21}$, the tendency of inductive coupling is increased, and the pass band of the dielectric resonant component is widened.

In the embodiment of FIGS. 8 and 9, by changing the ratio of $L_1$ to $L_2$, the ratio of d1 to d2, etc., the coupling condition of the respective dielectric resonators can be selected to be either the capacitive coupling or the inductive coupling, and the degree of coupling can be controlled. Therefore, the characteristics can be changed without changing the external dimension of the dielectric block 1, so that the parts can be standardized and the mass productivity can be improved.

Moreover, in the embodiment of FIGS. 8 and 9, by changing the diameter d1 of each of the inner conductor formation holes 5*a* and 5*b*, the values of the above-mentioned external coupling capacitances Ce can be changed. When the diameter d1 is increased, for example, the distances between the inner conductors 2 and the input/output electrodes 9*a* and 9*b* are reduced, so that the external coupling capacitances Ce are increased. In this case, the input/output electrodes 9*a* and 9*b* can be reduced in size, so that the occurrence of the electromagnetic field leakage can be further suppressed. Moreover, the reduced size of the input/output electrodes reduces the area of the portions of the outer conductor 4 which are to be removed, thereby allowing the characteristics thereof to be improved. Furthermore, in this embodiment, since the spurious resonant frequency can be prevented at integral multiples of the basic resonant frequency of the dielectric resonant component, spurious noise can largely be reduced.

Figure 11:
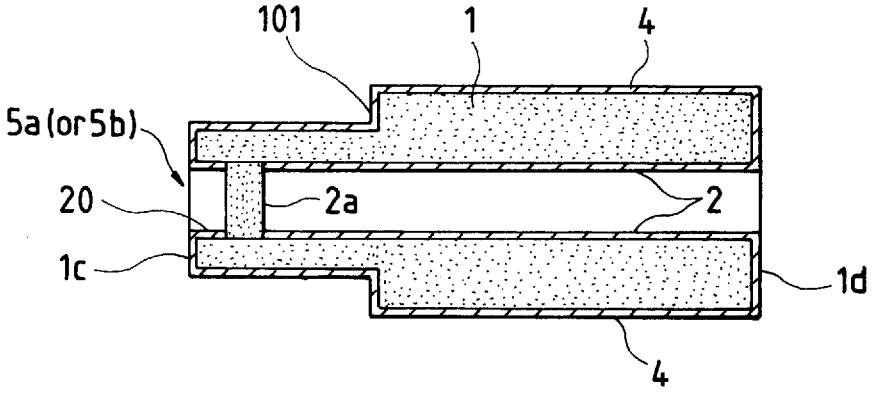
FIG. 11 is a sectional view showing a dielectric resonant component according to another embodiment of the invention.

In the embodiment of FIGS. 8 and 9, the stepped portion 51 is formed in the inside of each of the inner conductor formation holes 5*a* and 5*b*. Alternatively, as shown in FIG. 11, a stepped portion 101 may be formed on the outer surface of the dielectric block 1, so as to differentiate in level the line impedance in front of the stepped portion 101 from that in back of the stepped portion 101.

Figure 12:
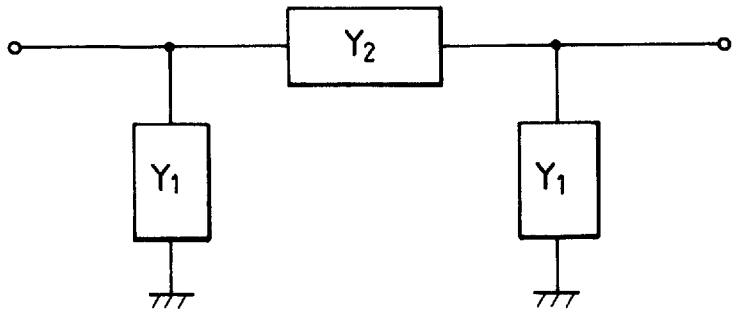
FIG. 12 is a circuit diagram showing an equivalent π-type circuit of a dielectric resonant component having a configuration in which a plurality of dielectric resonators are coupled in a single dielectric block.

Generally, a dielectric resonant component (e.g., a dielectric resonant component such as shown in FIGS. 8 and 9) having a structure in which a plurality of dielectric resonators are coupled in a single dielectric block can be represented by a π-type equivalent circuit, as shown in FIG. 12. In the circuit, the series branch $Y_1$ contributes to the coupling of the respective dielectric resonators. The frequency characteristics of the series branch $Y_1$ cause an attenuation pole to be produced in the frequency characteristics of the dielectric resonant component.

Figure 13:
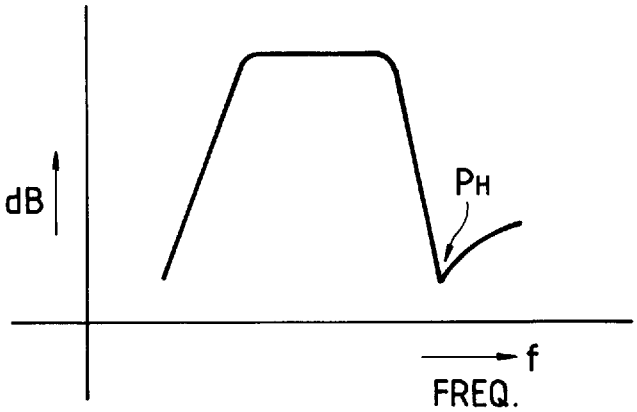
FIG. 13 is a graph showing the frequency characteristics of a dielectric resonant component in which only straight holes are provided as inner conductor formation holes.

In a case where all respective inner conductor formation holes formed in a dielectric block are straight holes or holes without a stepped portion, the frequency at which the admittance of the series branch $Y_1$ is 0 is equal to the frequency at which the admittance of the parallel branch $Y_2$ is 0, and therefore the dielectric resonators are not coupled. However, the presence of the tip capacitance Cs added to each dielectric resonator lowers the frequency at which the admittance of the parallel branch $Y_2$ is 0. As a result, an attenuation pole $P_H$ due to the series branch $Y_1$ is produced in the higher frequency side of the pass band (see FIG. 13). That is, in this case, the dielectric resonators are inductively coupled.

Figure 14:
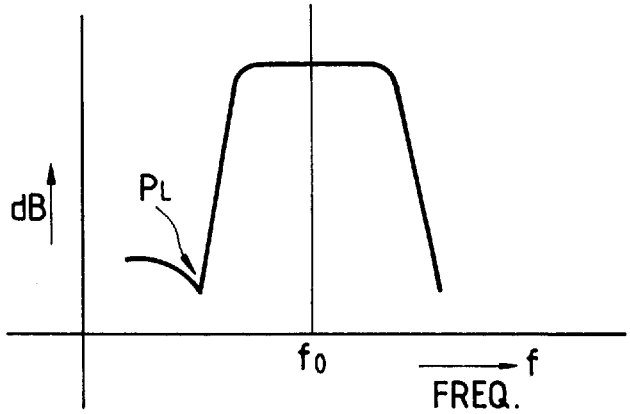
FIG. 14 is a graph showing the frequency characteristics of a dielectric resonant component in which only stepped holes are provided as inner conductor formation holes.

By contrast, in a case where all inner conductor formation holes formed in a dielectric block are stepped holes or holes with a stepped portion, the frequency at which the admittance of the series branch $Y_1$ is 0 is lower than the frequency at which the admittance of the parallel branch $Y_2$ is 0, and therefore an attenuation pole $P_L$ is produced in the lower frequency side of the pass band, even when the tip capacitance Cs is not provided (see FIG. 14). That is, in this case, the dielectric resonators are capacitively coupled. When the tip capacitance Cs is added to each dielectric resonator in this case, the frequency at which the admittance of the parallel branch $Y_2$ is 0 lowers, and the attenuation pole becomes closer to the center frequency $f_0$. When the tip capacitance Cs is further increased, the attenuation pole is produced in the higher frequency side of the pass band.

As described above, in the case where only straight holes are formed as the inner conductor formation holes, or in the case where only stepped holes are formed, the attenuation pole is produced in the either the higher frequency side or the lower frequency side of the pass band, thereby degrading the symmetry of the waveform. Therefore, it is difficult to use such a dielectric resonant component in an application (e.g., a bandpass filter) in which attenuation poles must be produced in both the higher and lower frequency sides.

A dielectric resonant component which can eliminate the above problem will be described below.

Figure 15:
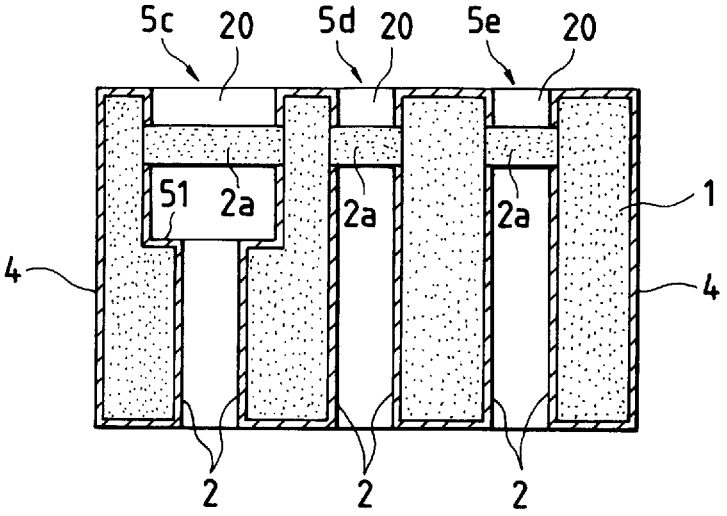
FIG. 15 is a sectional view showing a dielectric resonant component according to another embodiment of the invention in which the frequency characteristics are improved.
Figure 16:
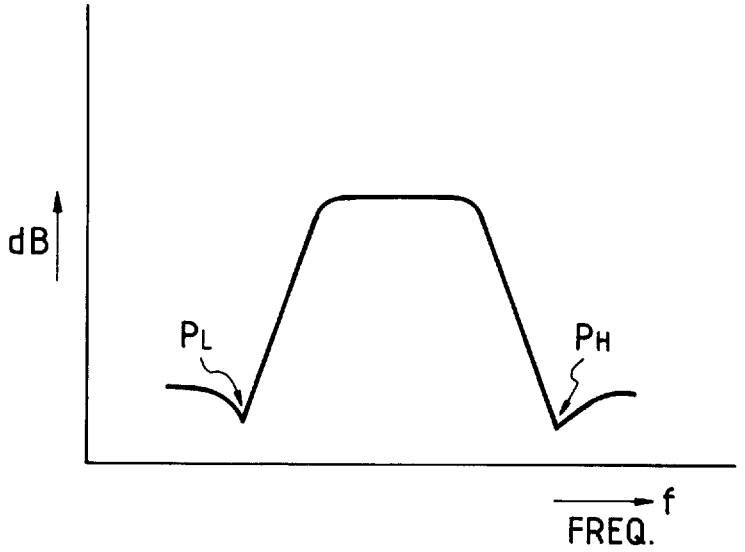
FIG. 16 is a graph showing the frequency characteristics of the dielectric resonant component of FIG. 15.

FIG. 15 is a sectional view showing the configuration of a dielectric resonant component of a still further embodiment of the invention. In the embodiment of FIG. 15, as inner conductor formation holes, a stepped hole 5*c* having a stepped portion 51, and straight holes 5*d* and 5*e* without stepped portions are formed in a dielectric block 1. The straight hole 5*d* is located at the center of the dielectric block 1. The stepped hole 5*c* and the straight hole 5*e* are located in the right and left sides of the dielectric block 1, respectively. The other configurational points are the same as those in the embodiment of FIGS. 8 and 9. Corresponding elements are designated by like reference numerals, and their description is omitted. In the dielectric resonant component having the configuration of FIG. 15, the stepped hole 5*c* and the straight hole 5*d* are capacitively coupled with each other so that an attenuation pole is produced in the lower frequency side. On the other hand, the straight holes 5*d* and 5*e* are inductively coupled with each other so that an attenuation pole is produced in the higher frequency side. Therefore, in the frequency characteristics as the whole, the attenuation poles $P_L$ and $P_H$ are respectively produced in the lower frequency and the higher frequency sides of the pass band as shown in FIG. 16.

Figure 17:
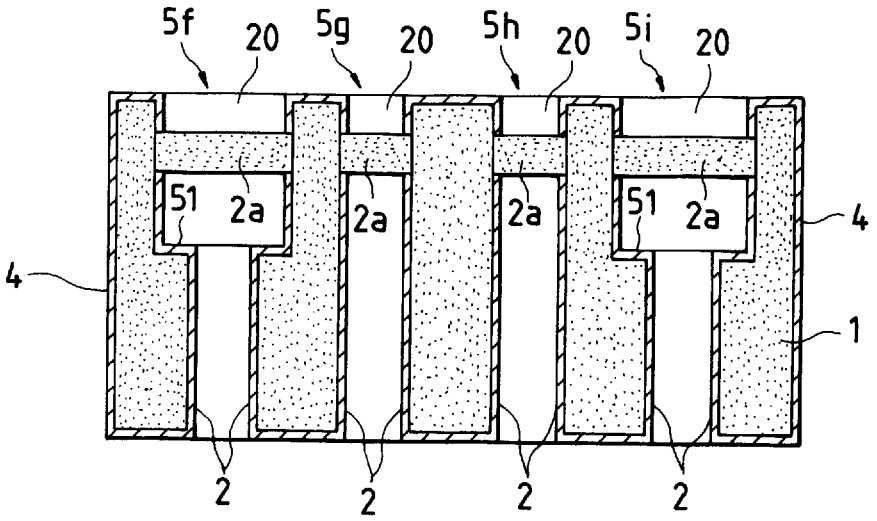
FIG. 17 is a sectional view showing a dielectric resonant component according to yet another embodiment of the invention in which the frequency characteristics are improved.
Figure 18:
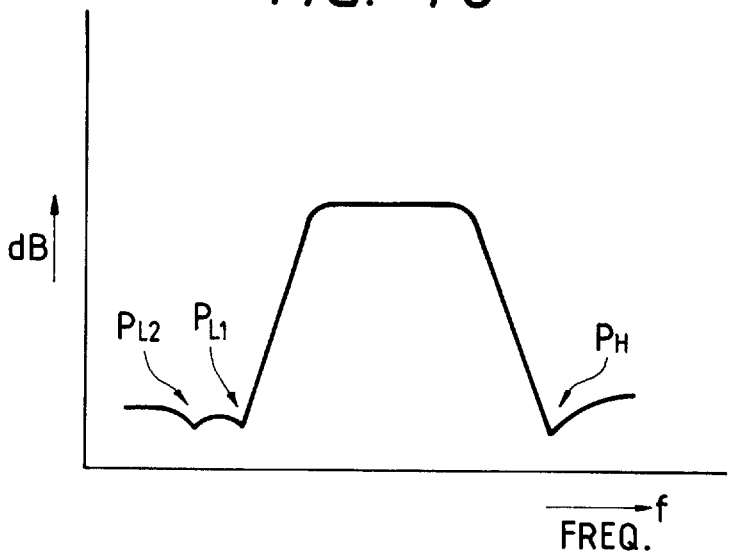
FIG. 18 is a graph showing the frequency characteristics of the dielectric resonant component of FIG. 17.

FIG. 17 is a sectional view showing the configuration of a dielectric resonant component of a still further embodiment of the invention. In the embodiment of FIG. 17, as inner conductor formation holes, stepped holes 5*f* and 5*i* each having a stepped portion 51, and straight holes 5*g* and 5*h* without a respective stepped portion are formed in a dielectric block 1. The straight holes 5*g* and 5*h* are juxtaposed at the center of the dielectric block 1. The stepped holes 5*f* and 5*i* are located in the right and left sides of the dielectric block 1, respectively. The other configurational points are the same as those in the embodiment of FIGS. 8 and 9. Corresponding elements are designated by like reference numerals, and their description is omitted. In the dielectric resonant component having the above configuration shown in FIG. 17, the stepped hole 5*f* and the straight hole 5*g*, and the stepped hole 5*i* and the straight hole 5*h* are capacitively coupled with each other, respectively, so that attenuation poles are produced in the lower frequency side. On the other hand, the straight holes 5*g* and 5*h* are inductively coupled with each other so that an attenuation pole is produced in the higher frequency side. Therefore, in the overall frequency characteristics, two attenuation poles $P_{L1}$ and $P_{L2}$ are produced in the lower frequency side of the pass band and one attenuation pole $P_H$ is produced in the higher frequency side as shown in FIG. 18. Thus, the dielectric resonant component of FIG. 17 is suitable for an application which requires greater attenuation in the lower frequency side than the higher frequency side.

Figure 19:
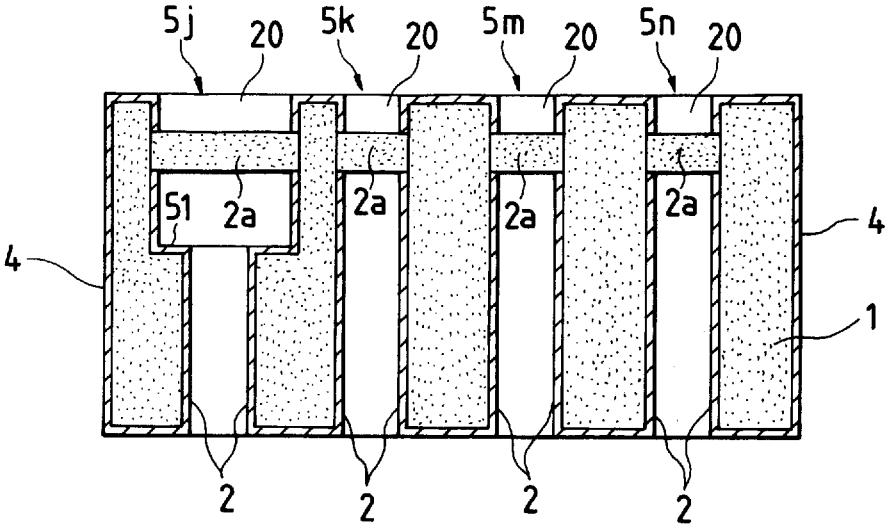
FIG. 19 is a sectional view showing a dielectric resonant component according to another embodiment of the invention in which the frequency characteristics are improved.
Figure 20:
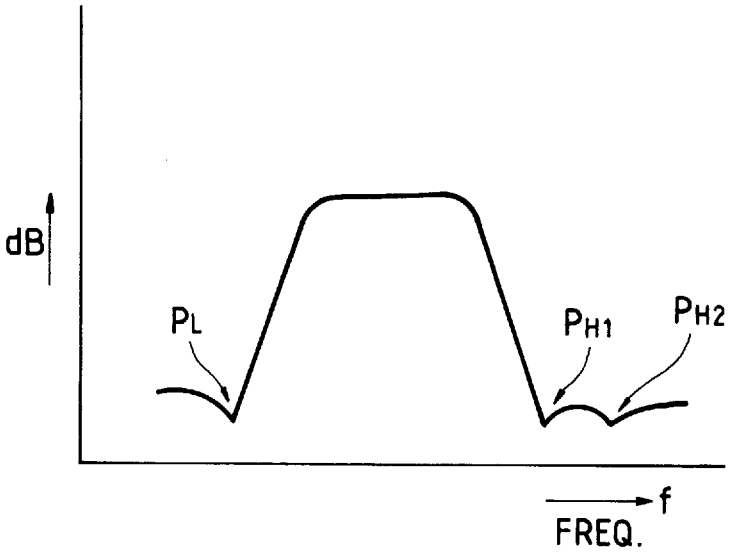
FIG. 20 is a graph showing the frequency characteristics of the dielectric resonant component of FIG. 19.

FIG. 19 is a sectional view showing the configuration of a dielectric resonant component according to a still further embodiment of the invention. In the embodiment of FIG. 19, as inner conductor formation holes, a stepped hole 5*j* having a stepped portion 51, and straight holes 5*k*, 5*m* and 5*n* without a stepped portion are formed in a dielectric block 1. The straight holes 5*k* and 5*m* are juxtaposed at the center of the dielectric block 1. The stepped hole 5*j* and the straight hole 5*n* are located in the right and left sides of the dielectric block 1, respectively. The other configurational points are the same as those in the embodiment of FIGS. 8 and 9. Corresponding elements are designated by like reference numerals, and their description is omitted. In the dielectric resonant component having the above configuration shown in FIG. 19, the stepped hole 5*j* and the straight hole 5*k* are capacitively coupled with each other so that an attenuation pole is produced in the lower frequency side. On the other hand, the straight holes 5*k* and 5*m*, and the straight holes 5*m* and 5*n* are inductively coupled with each other, respectively, so that attenuation poles are produced in the higher frequency side. Therefore, in the overall frequency characteristics, one attenuation pole $P_L$ is produced in the lower frequency side of the pass band, and two attenuation poles $P_{H1}$ and $P_{H2}$ are produced in the higher frequency side as shown in FIG. 20. Thus, the dielectric resonant component of FIG. 19 is suitable for an application which requires a greater attenuation in the higher frequency side than the lower frequency side.

Figure 21:
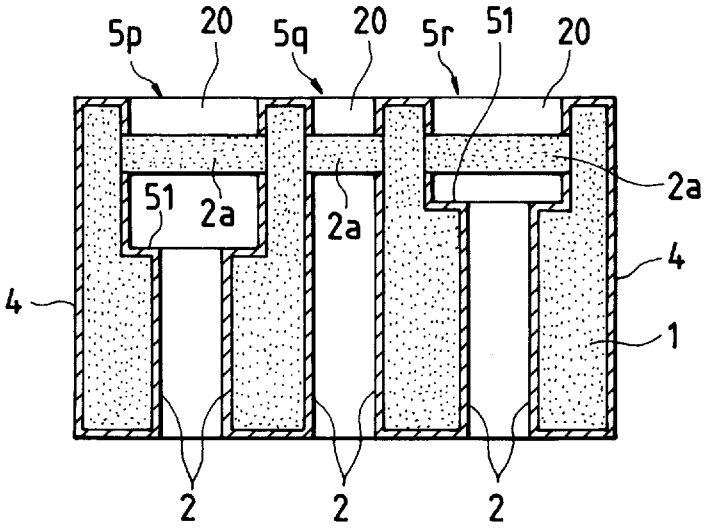
FIG. 21 is a sectional view showing a dielectric resonant component according to yet another embodiment of the invention in which the frequency characteristics are improved.

FIG. 21 is a sectional view showing the configuration of a dielectric resonant component according to a still further embodiment of the invention. In the embodiment of FIG. 21, as inner conductor formation holes, stepped holes 5*p* and 5*r* each having a stepped portion 51, and a straight hole 5*q* without a stepped portion are formed in a dielectric block 1. The straight hole 5*q* is located at the center of the dielectric block 1. The stepped holes 5*p* and 5*r* are located in the right and left sides of the straight hole 5*q*, respectively. The other configuration points are the same as those in the embodiment of FIGS. 8 and 9. Corresponding elements are designated by like reference numerals, and their description is omitted. In the dielectric resonant component of FIG. 21, the stepped hole 5*p* and the straight hole 5*q* are capacitively coupled with each other so that an attenuation pole is produced in the lower frequency side. In the stepped hole 5*r*, the position of the stepped portion 51 and the value of the tip capacitance Cs are selected to be different from those of the stepped hole 5*p*, thereby ensuring the inductive-coupling between the stepped holes 5*r* and 5*q*. Therefore, by the stepped hole 5*r* and the straight hole 5*q*, an attenuation pole is presented in the higher frequency side. As a result, in the overall frequency characteristics, as in the dielectric resonant component of FIG. 15, attenuation poles $P_L$ and $P_H$ are respectively produced in the lower frequency and the higher frequency sides of the pass band (see FIG. 16).

As described above, in the dielectric resonator according to the invention, the outer conductor is formed so as to cover the entire outer surface of the dielectric block, and a portion where the inner conductor is not formed is provided in the inside of the inner conductor formation hole. Therefore, the electromagnetic field leakage from the open end of the resonator can substantially completely be prevented from occurring. Because of the provision of the portion in which the inner conductor is not formed in the inside of the inner conductor formation hole, a tip capacitance is connected to the tip of the inner conductor. Therefore, the axial length of the dielectric block can be reduced, and hence the dielectric resonator can be miniaturized. In addition, the characteristics such as the resonant frequency of the dielectric resonator can be changed without changing the external dimension of the dielectric block, but only by changing the width and position of the inner conductor nonformation portion, the height and position of the stepped portion, etc. Therefore, the dimension of the dielectric block can be standardized, and the production cost can be lowered.

Also, according to the invention, the line lengths of the two resonant portions which are formed with the stepped portion as a boundary are selected to be different from each other. Therefore, the axial length of the dielectric block is further reduced.

Further, in the dielectric resonant component according to the invention, the outer conductor is formed so as to cover the entire outer surface of the dielectric block, and a portion where the inner conductor is not formed is provided in the inside of each of the inner conductor formation holes, so that the electromagnetic field leakage from the open end of each of the dielectric resonators can substantially completely be prevented. Since a cover for preventing the electromagnetic field leakage is not required, the number of parts can be reduced and the height can be reduced. Moreover, the characteristics (the resonant frequency of each of the dielectric resonators, the coupling coefficient between the respective dielectric resonators, and the coupling condition between the respective dielectric resonators) of the dielectric resonant component can be changed without changing the external dimension of the dielectric block, and without performing the adjustment using external coupling elements, but only by changing the width and position of the inner conductor nonformation portions, the height and position of the stepped portions, etc. Therefore, the dimension of the dielectric block can be standardized, and the number of parts can be reduced.

Further, according to the invention, an inner conductor formation hole with a stepped portion and an inner conductor formation hole without a stepped portion are combined in a single dielectric block, whereby the attenuation characteristics in both the higher frequency side and the lower frequency side can be improved.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric resonator, comprising:

a dielectric block having first and second surfaces opposite to each other, a stepped portion being provided at a predetermined position on said dielectric block;

an inner conductor formation hole extending through the dielectric block from the first surface to the second surface thereof;

an inner conductor formed on an entire inner surface of said inner conductor formation hole, except for a non-conductive portion where no inner conductor is formed being provided at a location closer to said first surface than to said second surface of said dielectric block on said inner surface of said inner conductor formation hole, said non-conductive portion extending in an axial direction of said inner conductor formation hole; and an outer conductor formed on an entire outer surface of said dielectric block;

first and second resonant portions of said resonator having respective line impedances that are different from each other and coacting to resonate at a predetermined resonant frequency of said resonator, said first and second resonant portions being formed by said inner conductor between said non-conductive portion and said stepped portion, and between said stepped portion and said second surface of said dielectric block, respectively, with said stepped portion defining a boundary between said first and second resonant portions;

said stepped portion being provided on said inner surface of said inner conductor formation hole, thereby defining a larger portion and a smaller portion of said inner conductor formation hole;

said first and second resonant portions being formed respectively in said larger and said smaller portions; and said non-conductive portion being formed in said larger portion of said inner conductor formation hole.

2. A dielectric resonator as claimed in claim 1, wherein said non-conductive portion is provided at a predetermined distance from said first surface of said dielectric block.

3. A dielectric resonator as claimed in claim 1, wherein said first and second resonator portions have respective lengths L1 and L2 which are different from each other, and at said predetermined resonant frequency, the sum (L1+L2) has a minimum value within a range defined by L1/L2<1.0.

4. A dielectric resonator as claimed in claim 1, wherein said dielectric block has a substantially rectangular parallelepiped shape.

5. A dielectric resonator as claimed in claim 1, wherein a cross-section of said dielectric block along a direction perpendicular to said inner conductor formation hole is circular.

6. A dielectric resonator as claimed in claim 1, wherein a cross-section of said dielectric block along a direction perpendicular to said inner conductor formation hole is square.

7. A dielectric resonator as claimed in claim 1, wherein a cross-section of said inner conductor formation hole along a direction perpendicular thereof is circular.

8. A dielectric resonator as claimed in claim 1, wherein a cross-section of said inner conductor formation hole along a direction perpendicular thereof is square.

9. A dielectric resonant component, comprising:

a dielectric block having first and second surfaces opposite to each other, a stepped portion being provided at a predetermined position on said dielectric block;

a plurality of inner conductor formation holes extending through the dielectric block from the first surface to the second surface thereof;

an inner conductor formed on an entire inner surface of each of said inner conductor formation holes, except for a non-conductive portion where no inner conductor is formed being provided at a location closer to said first surface than to said second surface of said dielectric block on said inner surface of each of said inner conductor formation holes, said non-conductive portion extending in an axial direction of said at least one inner conductor formation hole; and an outer conductor formed on an outer surface of said dielectric block;

each of said inner conductors cooperates with said outer conductor to constitute a separate dielectric resonator;

each of said dielectric resonators has first and second resonant portions with respective line impedances that are different from each other, said stepped portion defining a boundary between said first and second resonant portions, said first and second resonant portions being formed by said inner conductor between said non-conductive portion and said stepped portion, and between said stepped portion and said second surface of said dielectric block, respectively, and coacting to resonate at a predetermined resonant frequency of said resonator; and said stepped portion being formed on said inner surface of said at least one inner conductor formation hole, thereby defining a larger portion of a smaller portion of said at least one inner conductor formation hole;

said first and second resonant portions being formed in said larger and said smaller portions, respectively; and said non-conductive portion being formed in said larger portion of said at least one inner conductor formation hole.

10. A dielectric resonant component as claimed in claim 9, comprising said at least one inner conductor formation hole having said stepped portion, and further comprising an inner conductor formation hole without such a stepped portion.

11. A dielectric resonator as claimed in claim 9, wherein said first and second resonant portions of each of said dielectric resonators have respective lengths L1 and L2 which are different from each other, and at said predetermined resonant frequency, the sum (L1+L2) has a minimum value within a range defined by L1/L2<1.0.

12. A dielectric resonant component as claimed in claim 9, wherein said dielectric block has a substantially hexahedral shape.

13. A dielectric resonant component as claimed in claim 9, further comprising a pair of signal input/output electrodes which are formed on said outer surface of said dielectric block and electrically insulated from said outer conductor.

14. A dielectric resonant component as claimed in claim 9, wherein each said first resonant portion has even mode and odd mode impedances Ze1 and Zo1, respectively, and each said second resonant portion has even mode and odd mode impedances Ze2 and Zo2, respectively, and wherein Ze1/Ze2>Zo1/Zo2.

15. A dielectric resonant component as claimed in claim 9, wherein each said first resonant portion has even mode and odd mode impedances Ze1 and Zo1, respectively, and each said second resonant portion has even mode and odd mode impedances Ze2 and Zo2, respectively, and wherein Ze1/Ze2<Zo1/Zo2.

16. A dielectric resonant component as claimed in claim 9, wherein a respective stepped portion is provided on said inner surface of a plurality of adjacent said inner conductor formation holes, and a capacitance generated by said non-conductive portion of one said hole coacts with said corresponding first and second resonant portions to produce an attenuation pole at a higher frequency side of said passband.

17. A dielectric resonant component as claimed in claim 9, wherein said stepped portion is provided on said inner surface of at least one said inner conductor formation hole, said dielectric block further comprising at least a pair of inner conductor formation holes without such a stepped portion, said component having a passband with attenuation poles at both a lower frequency side and a higher frequency side thereof.

18. A dielectric resonant component as claimed in claim 9, wherein a respective stepped portion is provided on said inner surface of a plurality of adjacent said inner conductor formation holes, said component having a passband having an attenuation pole at a lower frequency side thereof.

19. A dielectric resonant component as claimed in claim 18, wherein each of said resonators has a respective stepped portion on said inner surface thereof.

20. A dielectric resonant component as claimed in claim 9, wherein said non-conductive portion is provided at a predetermined distance from said first surface of said dielectric block.

21. A dielectric resonator as claimed in claim 9, wherein said stepped portion is provided on said inner surface of at least one said inner conductor formation hole, said dielectric block further comprising at least one inner conductor formation hole without such a stepped portion.

22. A dielectric resonant component as claimed in claim 21, wherein said inner conductor formation holes with and without said stepped portions are adjacent to each other, said component having a passband having an attenuation pole at a lower frequency side thereof.

23. A dielectric resonant component as claimed in claim 22, further comprising a second inner conductor formation hole with a stepped portion, adjacent to said hole with no stepped portion but not adjacent to said first-mentioned hole with a stepped portion, said second hole having a capacitance generated by its respective non-conductive portion which coacts with its first and second resonant portions to provide said component with an attenuation pole at a higher frequency side of said passband.

24. A dielectric resonant component as claimed in claim 21, wherein said inner conductor formation holes with and without said stepped portions are adjacent to each other, thereby providing said component with a passband having an attenuation pole at a lower frequency side thereof;

further comprising a second inner conductor formation hole with a stepped portion, adjacent to said hole with no stepped portion but not adjacent to said first-mentioned hole with a stepped portion, said second hole having a capacitance generated by its respective non-conductive portion which coacts with its first and second resonant portions to provide said component with an attenuation pole at a higher frequency side of said passband.

25. A dielectric resonator, comprising:

a dielectric block having first and second surfaces opposite to each other, a stepped portion being provided at a predetermined position on said dielectric block;

an inner conductor formation hole extending through the dielectric block from the first surface to the second surface thereof;

an inner conductor formed on an entire inner surface of said inner conductor formation hole, except for a non-conductive portion where no inner conductor is formed being provided at a location closer to said first surface than to said second surface of said dielectric block on said inner surface of said inner conductor formation hole, said non-conductive portion extending in an axial direction of said inner conductor formation hole; and an outer conductor formed on an entire outer surface of said dielectric block;

first and second resonant portions of said resonator having respective line impedances that are different from each other and coacting to resonate at a predetermined resonant frequency of said resonator, said first and second resonant portions being formed by said inner conductor between said non-conductive portion and said stepped portion, and between said stepped portion and said second surface of said dielectric block, respectively, with said stepped portion defining a boundary between said first and second resonant portions;

said stepped portion being provided on said outer surface of said dielectric block, thereby defining a first portion of said inner conductor formation hole surrounded by thinner dielectric material and a second portion surrounded by thicker dielectric material;

said first and second resonant portions being formed respectively in said first and said second portions; and said non-conductive portion being formed in said first portion of said inner conductor formation hole.

26. A dielectric resonant component, comprising:

a dielectric block having first and second surfaces opposite to each other, a stepped portion being provided at a predetermined position on said dielectric block;

a plurality of inner conductor formation holes extending through the dielectric block from the first surface to the second surface thereof;

an inner conductor formed on an entire inner surface of each of said inner conductor formation holes, except for a non-conductive portion where no inner conductor is formed being provided at a location closer to said first surface than to said second surface of said dielectric block on said inner surface of each of said inner conductor formation holes, said non-conductive portion extending in an axial direction of said at least one inner conductor formation hole; and an outer conductor formed on an outer surface of said dielectric block;

each of said inner conductors cooperates with said outer conductor to constitute a separate dielectric resonator;

each of said dielectric resonators has first and second resonant portions with respective line impedances that are different from each other, said stepped portion defining a boundary between said first and second resonant portions, said first and second resonant portions being formed by said inner conductor between said non-conductive portion and said stepped portion, and between said stepped portion and said second surface of said dielectric block, respectively, and coacting to resonate at a predetermined resonant frequency of said resonator;

said stepped portion being formed on said outer surface of said dielectric block, thereby defining a first portion of said at least one inner conductor formation hole surrounded by thinner dielectric material and a second portion of said at least one inner conductor formation hole surrounded by thicker dielectric material;

said first and second resonant portions being formed in said first and said second portions, respectively; and said non-conductive portion being formed in said first portion of said inner conductor formation hole.

* * * * *